United States Patent [19]

Golden

[11] 4,425,740

[45] Jan. 17, 1984

[54] EDGE CONNECTED THREE DIMENSIONAL STRUCTURES

[76] Inventor: Frederick L. Golden, 1415 Beechwood, Ann Arbor, Mich. 48103

[21] Appl. No.: 212,121

[22] Filed: Dec. 2, 1980

[51] Int. Cl.[3] ..... E04B 1/32

[52] U.S. Cl. ..... 52/81; 52/482; 52/271; 52/DIG. 10; 220/339; 220/80; 220/81 R; 160/231 A

[58] Field of Search ..... 52/476, 482, 271, 285, 52/81, 86, DIG. 10, 82; 160/135, 380, 231 A; 46/31, 21; 220/339, 80, 8 R; 16/DIG. 12, 225

[56] References Cited

U.S. PATENT DOCUMENTS

| | | | |
|---|---|---|---|
| 2,458,537 | 1/1949 | Skelly | 160/229 |
| 2,829,081 | 4/1958 | Sweem | 154/118 |
| 2,982,290 | 5/1961 | Huntziker | 52/81 |
| 3,142,550 | 7/1964 | Keuehne | 160/371 |
| 3,297,077 | 1/1967 | Garbus | 160/231 |
| 3,314,551 | 4/1967 | Plastow | 211/178 |
| 3,340,546 | 7/1967 | Moore | 16/225 |
| 3,445,970 | 5/1969 | Nelson | 52/82 |
| 3,562,975 | 2/1971 | Moss | 52/80 |
| 3,592,289 | 7/1971 | Aysta et al. | 181/30 |
| 3,640,034 | 2/1972 | Shotwell | 52/82 |
| 3,662,807 | 5/1972 | Miller | 160/135 |
| 3,692,035 | 9/1972 | Houston | 135/25 |
| 3,709,237 | 1/1973 | Smith | 135/5 R |
| 3,729,045 | 4/1973 | MacDonald | 52/476 |
| 3,793,758 | 2/1974 | Feldhusen | 46/31 |
| 4,048,770 | 9/1977 | McKenzie | 52/81 |
| 4,065,900 | 1/1978 | Eggert | 52/476 |
| 4,118,901 | 10/1978 | Johnson | 52/18 |
| 4,144,924 | 3/1979 | Vanden Hoek | 160/231 |
| 4,161,850 | 7/1979 | Peterson et al. | 52/65 |

FOREIGN PATENT DOCUMENTS

| | | | |
|---|---|---|---|
| 1298440 | 6/1969 | Fed. Rep. of Germany | 46/31 |

OTHER PUBLICATIONS

Domebook II ©1971, p. 70.

*Primary Examiner*—Henry E. Raduazo
*Attorney, Agent, or Firm*—James M. Deimen

[57] ABSTRACT

The invention comprises means of constructing insulated enclosures and structures for housing, storage, emergency shelter and vacation homes. The structural materials required comprise principally only two components, panels of plastic insulating foam and extruded plastic connectors.

The panels are shaped and sized to eliminate virtually all waste when cut from 4 foot by 8 foot sheets of rigid insulating foam. A single extruded connector joins the panels together along mutually adjacent edges and eliminates the need for complicated geometric connectors where three or more panels adjoin. The hinged configuration of the extruded connectors permits a virtually unlimited variety of structural enclosures to be constructed with 4 foot by 8 foot sheets of insulating foam plastic. Disclosed for illustration are a dome shaped structure with a plurality of alcoves extending outwardly from the periphery of the structure and other free form structures of "crystalline" shape.

The extruded connectors are formed with three integral hinges, two of which permit panels to be easily inserted into the connectors and the third accommodating a wide variety of angles between the intersecting panels.

17 Claims, 17 Drawing Figures

EDGE CONNECTED THREE DIMENSIONAL STRUCTURES

BACKGROUND OF THE INVENTION

The field of the invention pertains to structural enclosures for housing, storage and emergency shelter and includes means of joining components together to form the structural enclosures. In particular, the invention pertains to panel and connector structures that may be simply and quickly constructed without complicated and expensive components.

Examples of such structures are illustrated in U.S. Pat. Nos. 3,562,975 and 4,118,901. The first patent discloses a dome shaped structure of curved plywood panels with foam insulation fastened to the interior surfaces. Flexible connectors join the panels together along adjacent adges. The second patent discloses a polygonal structure of flat panels and discrete hinges. This structure may be folded and unfolded.

Of a simpler nature are the sportsman's blind, U.S. Pat. No. 3,709,237, and room divider, U.S. Pat. No. 4,161,850, again showing panels joined by flexible hinges in the former and discrete mechanical hinges in the latter. Panels joined by flexible hinges are prevalent for folding doors and flexible wall structures. U.S. Pat. Nos. 3,297,077 and 2,829,081 illustrate folding door constructions embodying flexible hinges. U.S. Pat. Nos. 2,458,527, 3,592,289 and 4,144,924 disclose flexible wall structures and panel systems having flexible extruded hinges joining the panels together. Such flexible hinges are also used to join display devices together as illustrated in U.S. Pat. No. 3,314,551 and the panels of an umbrella as illustrated in U.S. Pat. No. 3,692,035.

SUMMARY OF THE INVENTION

The invention comprises means of constructing insulated enclosures, room dividers and structures for housing, storage, emergency shelter and vacation homes. The structural materials required comprise principally only two basic components, panels of plastic insulating foam and flexible extruded plastic connectors. Depending upon the adhesives utilized to join the panels to the connectors the structures may be permanent, i.e., intended for use in one location for a number of years or temporary, i.e., intended for use in an emergency lasting a matter of days, weeks or months, after which the structure may be disassembled and the parts stored for future use.

The connectors comprise an extruded plastic shape including a triple hinge feature that enables the panels to be quickly and easily joined to the connectors during assembly of the structure. The connector and panel system joins two panels together along mutually adjacent panel edges. The connectors are merely cut to the length required. Where three or more panels adjoin no connection means is normally used thus eliminating the need for complicated and expensive structural joints at the vertices. This feature is particularly important with respect to dome shaped and "crystalline" structures which may be very economically constructed with applicant's panels and connectors, but which are very expensive when constructed with specialized joint connectors at the intersection of three or more panels. Geodesic domes are illustrative of the more expensive vertex connected constructions.

The structures, in their most advantageous forms, virtually eliminate wastage of construction materials.

The dome shaped and "crystalline" structures illustrated herein are constructed with standard rectangular 4 foot by 8 foot plastic insulating foam panels cut into triangular shapes that are sized to eliminate wastage of any portion of the standard rectangular panels. The variety of structural configurations obtainable with little or no wastage is limited only by the imagination and not limited by the illustrations disclosed herein.

The edge connectors may be formed from extruded polypropylene or polyethylene plastic. Such materials form an excellent flexible hinge or "living" hinge as an integral part of the shape. Two of the three hinges of applicant's edge connector permit convenient insertion of the panels into the connector and the third hinge allows the panels to intersect at any angle necessary for the shape of the structure. The structures are weatherproofed by applying adhesive backed foil or waterproof tape to cover the edge connectors and joints where three or more panels adjoin.

The resulting structures combine lightness and strength that is very surprising. For example, the structure disclosed herein in the form of a dome with alcoves is approximately 22 feet in diameter, 11½ feet in height and weighs approximately 320 pounds. The structure nevertheless has sufficient strength to withstand the snow loadings to be expected in northern climates and high wind loadings at any location. In the event of tornadic or hurricane force winds or even earthquake beyond the strength of the structure, collapse of such a light weight structure onto persons therein is unlikely to produce crushing injuries.

DESCRIPTION OF THE PREFERRED EMBODIMENTS

Figure 1:
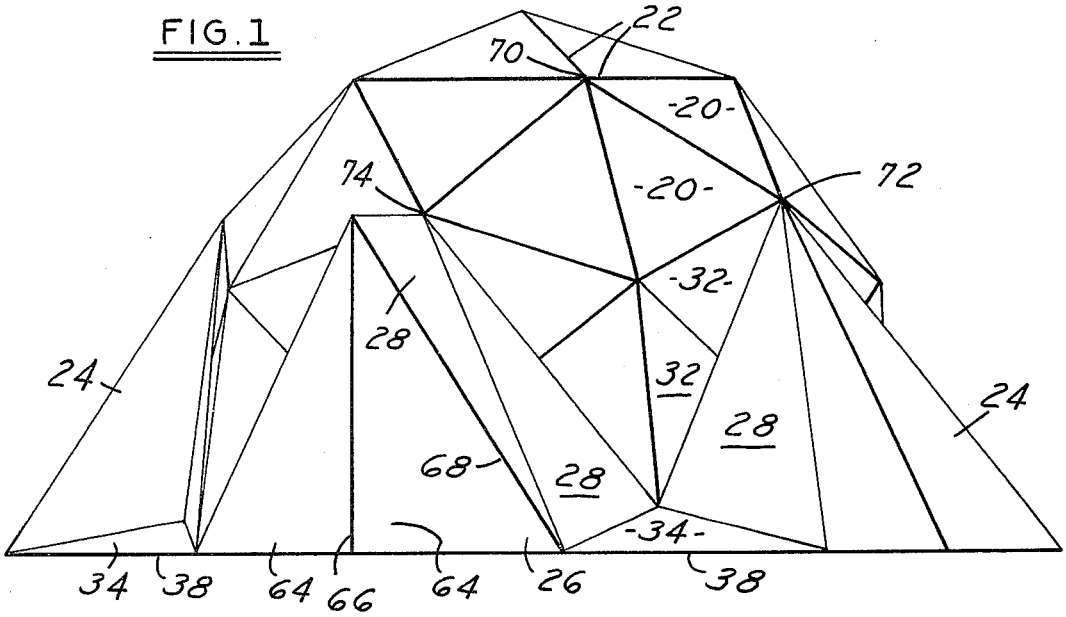
FIG. 1 is a side view of a dome structure according to the invention.
Figure 2:
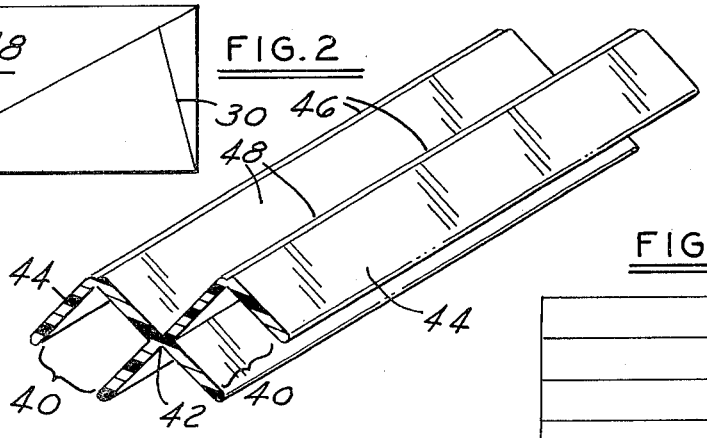
FIG. 2 is a perspective view of an edge connector.

In FIGS. 1 andd 12 a side view and a top view of a dome structure are illustrated. The dome comprises a plurality of triangular panels 20. The panels 20 are joined together with edge connectors 22 shaped as shown in FIG. 2. About the periphery of the dome are five alcoves 24 one of which 26 is modified to provide an entrance to the dome. The alcoves 24 and entrance 26 are formed with triangular panels 28 and edge connectors 22. All of the joints between any two panels of the dome utilize the edge connector shown in FIG. 2 cut to required length.

Figure 6:
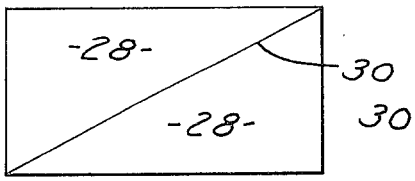
FIGS. 6 through 10 illustrate the cutting patterns for the panels of a structure such as that shown in FIG. 1.
Figure 7:
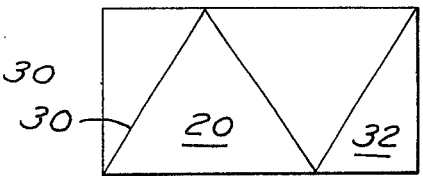
Figure 8:
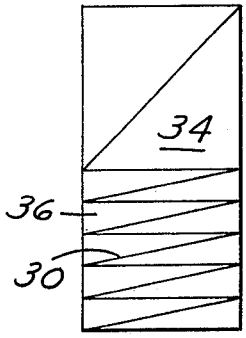
Figure 9:
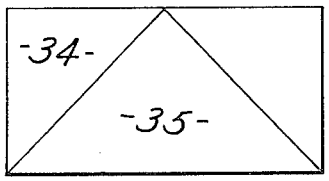
Figure 10:
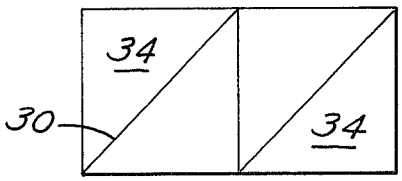

The dome of FIG. 1 is constructed of one half inch thick rigid plastic insulating foam faced on both sides with heat reflective aluminum foil. Four foot by eight foot sheets of rigid insulating foam faced with heat reflective aluminum foil on one or both sides are commonly available from building supply centers. The sheets of rigid insulating foam are cut as shown by the lines 30 in FIGS. 6 through 10 to form the various panels of the dome. For example, panels 20 and 32 are cut as shown in FIG. 7 and panels 28 as shown in FIG. 6. Several sheets are, of course, required for a sufficient number of panels 20. The structure of FIG. 1 is approximately 22 feet in diameter. The panels 34, between the alcoves 24, tilt upwardly gently as shown to prevent the collection of rain water and are supported by the narrow panel triangles 36 shown in FIGS. 8 and 11. Additional panels 38 rest on the ground upon which the structure rests. The panels 38 are identical in size to the panels 34 and positioned directly thereunder. The dome of FIGS. 1 and 12 requires eleven sheets as cut in FIG. 6, ten sheets as cut in FIG. 7, one sheet as cut in FIG. 8 and two sheets as cut in FIG. 10.

The edge connector 22 as shown in FIG. 2 comprises double extruded channels 40 joined by a central flexible hinge therebetween at 42. The outside side 44 of each channel 40 is similarly joined by a lateral flexible hinge 46 to the channel bottom 48. The connector 22 is formed from extruded polypropylene or polyethylene with the three hinges an integral part of the extrusion. The central hinge 42 provides a full 180° range of angular relative position between the channels 40. The channel opening is sized to accept the one half inch thick panels described above. The connector is, however, not limited to the one half inch thickness but may be extruded in different sizes to accommodate thicker or thinner panel thicknesses.

Figure 3:
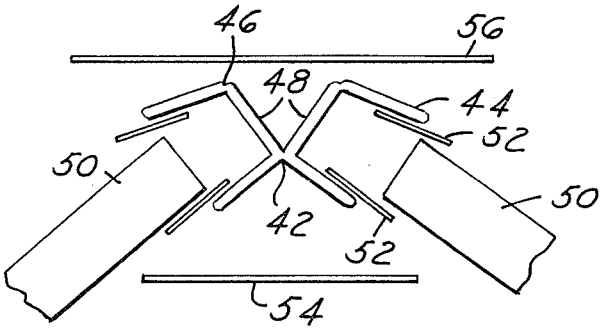
FIG. 3 is an exploded view of the connection between two panels.
Figure 5:
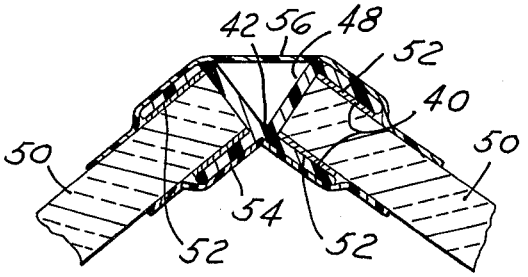
FIG. 5 is a cross-section of a joint between panels taken along the line 5—5 in FIG. 4.
Figure 4:
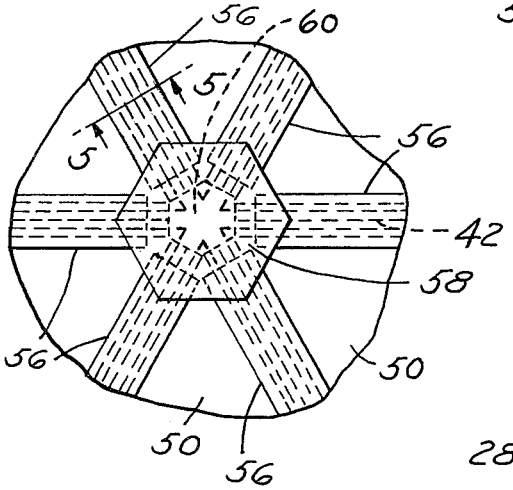
FIG. 4 is a view of a juncture among several panels.

The method of assembly is shown in FIGS. 3, 4 and 5. The hinges 46 of the connector 22 permit the panels 50 to be fully inserted to the channel bottoms 48 without difficulty. To affix the panels to the connectors, strips of double side adhesive tape 52 are affixed to the channel sides or the panels. The panels are then inserted into the connector channels 40 and the channel side 44 pressed against the panel. Alternatively, an adhesive may be coated onto the panels or into the channels to tightly bond the panels to the connectors. The adhesive may be selected to permanently bond the structure together or to permit the outside side 44 to be easily peeled back at a future time when the structure is to be dismantled. Panels that are damaged may be easily replaced by peeling back the channel side 44. Acrylic base adhesives are suitable for permanent structures and non-hardening rubber base adhesives are suitable for temporary structures.

To provide a weatherproof airtight ultraviolet resistant seal, adhesive backed foil or vinyl tapes 54 and 56 are applied to the finished joints after the structure is completed and the angular relationship of the pair of channels 40 about the hinge 42 is fixed for each connector 22. At the juncture of several panels as shown in FIG. 4, adhesive backed foil or viny tape covers 58 are applied to both sides of the opening 60 where the panels and connectors adjoin.

Figure 11:
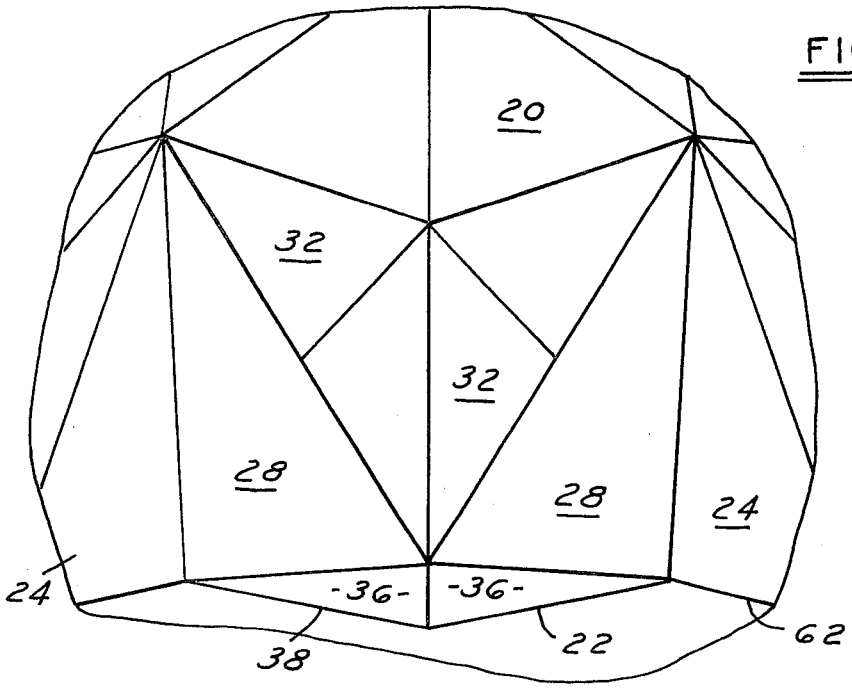
FIG. 11 is an interior view of a portion of the dome structure of FIG. 1.

FIG. 11 illustrates the interior of the dome structure between two alcoves 24. The narrow triangular panel 36 is positioned underneath the joint between panel 28 and panel 34. The top edge of the panel 36 is capped by a channel 40 formed by splitting an edge connector 22 along the central hinge 42. The panel 36 is then taped with adhesive backed foil to the panel 28 thereabove. All other exposed panel edges such as the bottom of the alcove at 62 are likewise capped with a channel. The bottom of the triangular panel 36, however, is attached by a connector 22 to the panel 38 extending underneath panel 34.

Returning to FIG. 1 the entrance 26 includes a double door 64 formed from two of the panels 28 trimmed to fit. The edge connector 22 is deleted from the vertical joint 66 therebetween. The hinges 42 of the edge connectors 22 located at 68 thereby act as the door hinges for the door 64.

Figure 12:
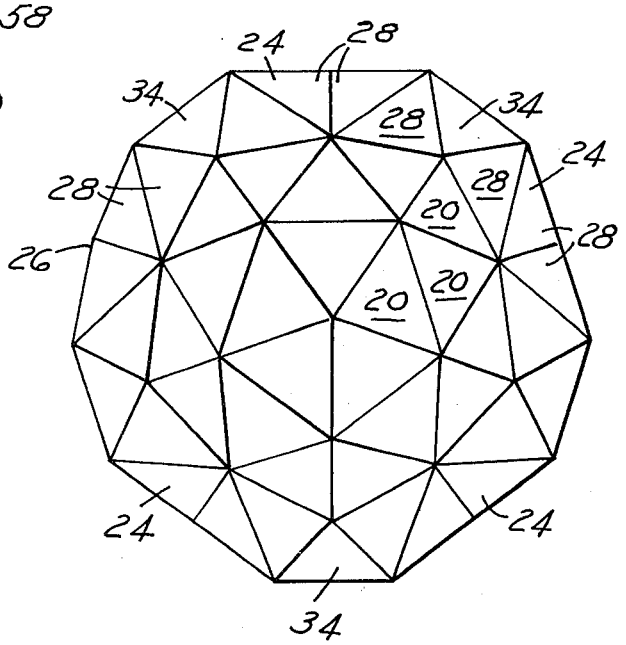
FIG. 12 is a top view of the dome of FIG. 1.
Figure 13:
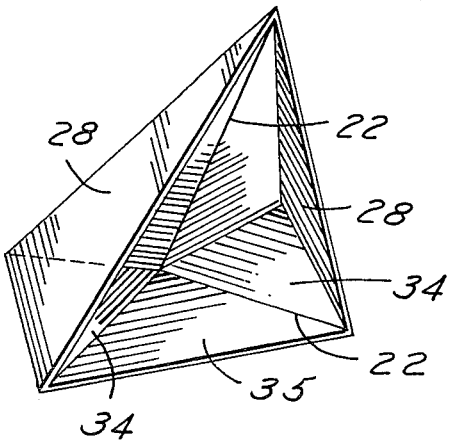
FIG. 13 is a perspective view of a room divider.

The plan or top view of the dome in FIG. 12 shows the position of the exterior panels of the dome with the exception of those panels extending vertically such as the doors 64 and panels 32. FIGS. 1 and 12 illustrate a variety of intersections where several panels adjoin with a complicated geometry. The juncture illustrated in FIG. 4 shows intersections such as 70 in FIG. 1, however, intersections such as 72 and 74 embody a more complicated geometry. Nevertheless, these intersections are constructed and sealed in the same manner as that shown in FIG. 4. This feature of applicant's construction eliminates the need for complicated, expensive specially made connectors at the juncture of several panels and permits economical construction of alcoves, entranceways and "crystalline" structures.

FIG. 3 illustrates an interior partition or alcove constructed with panels 28, 34 and 35 and the edge connectors 22 joining the panels together. As with the dome structure and other panel and connector structures, the angular relationships of the panels provide the rigidity of the complete structure. As shown the interior alcove is resting upon panel 35, however, the structure may also be rested on either of the side panels 28. The rigid insulating foam panels are sufficiently light to permit the interior partitions to be moved about conveniently by one person.

Figure 16:
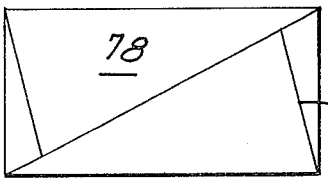
FIG. 16 illustrates the cutting pattern for additional structural panels; and, FIG. 17 illustrates the cutting pattern for reinforcement panels.
Figure 15:
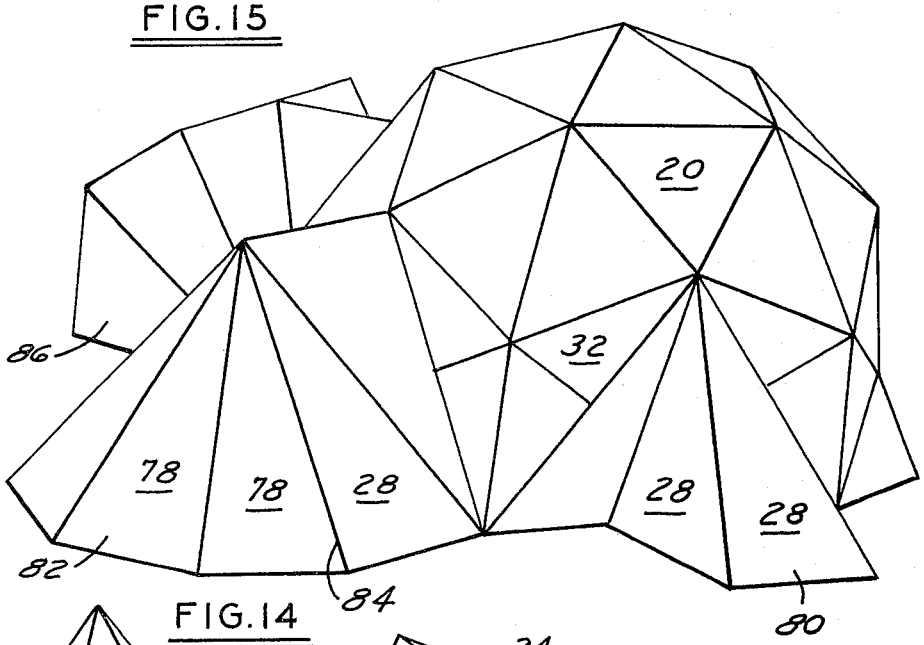
FIG. 15 is a perspective view of an interconnected structure.
Figure 14:
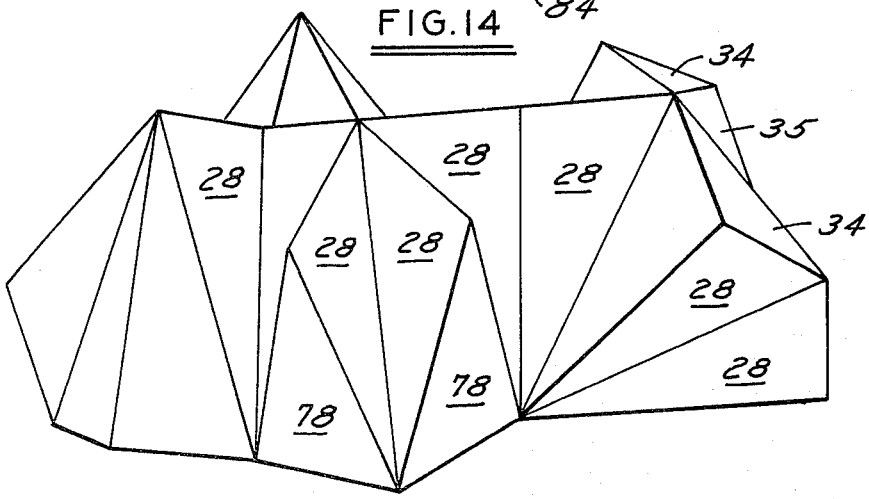
FIG. 14 is a perspective view of a "crystalline" structure.

The structures illustrated in FIGS. 14 and 15 demonstrate the imaginative configurations possible with the panels andd edge connectors disclosed above. FIG. 14 illustrates a "crystalline" structure based predominately upon the use of triangular panel 28. As is apparent the panels can be fitted together in a myriad of ways to provide a full or partial enclosure. The double alcove 76, however, utilizes an additional slightly smaller triangular panel 78 cut from a standard sheet as shown in FIG. 16.

FIG. 15 illustrates an interconnected structure based on the dome. A small alcove 80 constructed with panels 28 extends from one side. From a second side a large room 82 extends, also constructed with panels 28. The panels 28 extend about the end of the room 82. Thus, arcuate and tentlike rooms can be added to a central dome as desired. As is apparent, domes can be joined together by attaching a second dome at the location of the edge connector 84. On a third side of the dome a T-shaped room 56 is attached.

Figure 17:
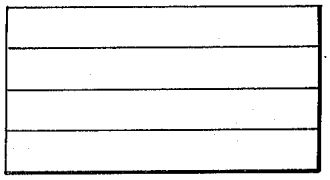

FIG. 17 illustrates the cutting pattern of rectangular reinforcing strips that may be applied or taped to the base of extended wall spans such as across the base of alcoves 24 in FIG. 1.

The structures illustrated and described above are based upon the use of light weight foil covered rigid insulating foam panels of four foot by eight foot size, however, the structures may be based on panels of different size but retaining the two to one length to width ratio. The panels may be constructed of other less or more permanent materials. Examples are corrugated cardboard, plywood, chipboard, metal panels and panels coated with enamel, epoxy, polytetrafluoroethylene and other protective materials. Substitute tapes for the adhesive foil or vinyl tapes may be also used for decorative or other purposes. The structures described above, however, provide the greatest insulating value for the lowest cost by utilizing panels of insulating foam double sided with heat reflective foil and by utilizing foil tapes over the connectors and intersections of multiple panels.

I claim:

1. A panel connector for multipanel structural shapes comprising a pair of parallel channels, central hinge means joining the parallel channels together lengthwise of the channels, separate lateral hinge means joining at least one relatively rigid channel side to a corresponding relatively rigid channel bottom lengthwise of the channel and one side of at least one channel being non-hinged to the channel bottom, said central integral hinge joining the channels together adjacent the juncture of the non-hinged channel side and the corresponding channel bottom of the one channel.

2. A panel connector for multipanel structural shapes comprising at least two parallel channels, each channel including at least two substantially rigid sides and a substantially rigid bottom, a central integral hinge joining at least two parallel channels together lengthwise of the parallel chanels, a separate lateral integral hinge joining at least one side of one channel to the bottom of the same channel lengthwise of the same channel and one side of at least one channel being non-hinged to the channel bottom, said central integral hinge joining the channels together adjacent the juncture of the non-hinged channel side and the corresponding channel bottom of the one-channel.

3. The panel connector of claim 2 wherein at least two channels each have a side non-hinged to the corresponding channel bottom and wherein the central integral hinge joins the channels together adjacent the junctures of the non-hinged channel sides and corresponding bottoms of the two channels.

4. The panel connector of claim 2 wherein at least two parallel channels are movable up to 180° relative to each other about the central hinge.

5. A structural shape comprising a plurality of panels and a plurality of panel connectors joining pairs of panels together along mutually adjacent and parallel panel edges, said panel connectors including a plurality of parallel channels, each channel adapted to engage a panel edge, central integral flexible hinge means joining at least two channels of a panel connector together lengthwise of the channels, separate lateral integral flexible hinge means joining lengthwise of a channel at least one relatively rigid channel side to the corresponding relatively rigid channel bottom and one side of at least one channel being non-hinged to the channel bottom, said central integral hinge joining the channels together adjacent the juncture of the non-hinged channel side and the corresponding channel bottom of the one channel, and adhesive means affixing the panel edges to the corresponding channels.

6. The structural shape of claim 5 wherein the panels are affixed adhesively to the channel sides.

7. The structural shape of claim 5 wherein adhesive backed tape is affixed to cover the panel connectors joining pairs of panels.

8. The structural shape of claim 5 wherein adhesive backed tape is affixed to cover the juncture of three or more panels.

9. The structural shape of claim 5 comprising a plurality of flat triangular panels cut from at least one rectangular panel having a two to one length to width ratio without wastage of a portion of the rectangular panel.

10. A dome shaped structure comprising a plurality of triangular shaped flat panels and a plurality of panel connectors joining pairs of panels together along mutually adjacent and parallel panel edges, a plurality of alcoves extending from the dome shaped structure, said alcoves comprising a plurality of triangular shaped flat panels connected together and to dome panels along mutually adjacent and parallel panel edges, some of said panel and panel connectors being mutually unconnected at the juncture of more than two panels, at least some of said panel connectors comprising an extruded plastic double channel, an integral flexible plastic hinge joining said double channel together lengthwise of the double channel on the inside of the structure, at least one separate lateral hinge joining a channel side to a channel bottom, and a channel side being non-hingedly attached lengthwise to a channel bottom adjacent the hinge joining the double channel together lengthwise, the lateral hinge being spaced from the hinge joining the double channel together.

11. A room divider structure comprising a plurality of triangular shaped flat panels and a plurality of panel connectors joining pairs of panels together along mutually adjacent and parallel panel edges to form a partial enclosure, said panels and panel connectors being mutually unconnected at the juncture of more than two panels, at least some of said panel connectors comprising an extruded plastic double channel, an integral flexible plastic hinge joining said double channel together lengthwise of the double channel on the inside of the structure, at least one separate lateral hinge joining a channel side to a channel bottom, and a channel side being non-hingedly attached lengthwise to a channel bottom adjacent the hinge joining the double channel together lengthwise, the lateral hinge being spaced from the hinge joining the double channel together.

12. A "crystalline" shaped structure comprising a plurality of triangular shaped flat panels and a plurality of panel connectors joining pairs of panels together along mutually adjacent and parallel panel edges, at least some of said panels and panel connectors being mutually unconnected at the juncture of more than two panels, at least some of said panel connectors comprising an extruded plastic double channel, an integral flexible plastic hinge joining said double channel together lengthwise of the double channel on the inside of the structure, at least one separate lateral hinge joining a channel side to a channel bottom and a channel side being non-hingedly attached lengthwise to a channel bottom adjacent the hinge joining the double channel together lengthwise, the lateral hinge being spaced from the hinge joining the double channel together.

13. The structure of claims 10, 11, or 12 wherein said panels are formed from sheets of rigid foam insulation board.

14. The structure of claim 13 wherein said sheets of rigid foam insulation are rectangular with a two to one length to width ratio and the triangular panels are formed therefrom without substantial wastage.

15. The structure of claim 13 wherein said sheets of rigid foam insulation are covered on at least one side with a heat and light reflective surface.

16. The structure of claims 10, 11 or 12 including a sealing tape affixed to cover the panel connectors.

17. The structure of claims 10, 11 or 12 including a sealing tape affixed to cover the juncture of two or more panels.

* * * * *